US006112397A

United States Patent [19]

Boe

[11] Patent Number: 6,112,397

[45] Date of Patent: Sep. 5, 2000

[54] METHOD OF APPLYING TORQUE TO A CPU FAN UNIT

[75] Inventor: Craig L. Boe, Nampa, Id.

[73] Assignee: Micron Electronics, Inc., Nampa, Id.

[21] Appl. No.: 08/934,429

[22] Filed: Sep. 19, 1997

[51] Int. Cl.[7] ..... B21D 39/00

[52] U.S. Cl. ..... 29/456; 29/525.11; 29/407.02; 29/240; 29/240.5; 81/155; 81/163; 81/170

[58] Field of Search ..... 29/456, 525.11, 29/407.02, 240, 240.5; 81/155, 163, 170

[56] References Cited

U.S. PATENT DOCUMENTS

| | | | |
|---|---|---|---|
| D. 238,660 | 2/1976 | Ruefli . | |
| 519,582 | 5/1894 | Lerch . | |
| 594,023 | 11/1897 | Krueger | 81/155 |
| 673,056 | 4/1901 | Jacobs . | |
| 897,857 | 9/1908 | Spaulding . | |
| 1,063,717 | 6/1913 | Metcalf . | |
| 2,417,926 | 3/1947 | Ghiglieri . | |
| 2,435,346 | 2/1948 | Ghiglieri . | |
| 2,801,562 | 8/1957 | Stricklett et al. . | |
| 3,094,022 | 6/1963 | Young . | |
| 3,253,486 | 5/1966 | Beck . | |
| 3,654,825 | 4/1972 | Moddemeijer et al. . | |
| 3,662,628 | 5/1972 | Schnepel . | |
| 4,296,616 | 10/1981 | Guiler . | |
| 4,305,315 | 12/1981 | Neppel . | |
| 4,336,729 | 6/1982 | Eppenbach . | |
| 5,123,310 | 6/1992 | McManus . | |
| 5,523,918 | 6/1996 | Chiou . | |

*Primary Examiner*—P. W. Echols
*Assistant Examiner*—John C. Hong
*Attorney, Agent, or Firm*—Knobbe, Martens, Olson & Bear, LLP

[57] ABSTRACT

Disclosed is a method of applying torque to a CPU fan unit. One embodiment of the method comprises providing a tool having two mounting pins adjustably positioned along a common axis. The position of the mounting pins is then adjusted so that the mounting pins are positioned to engage the CPU fan unit. The pins are then engaged with the fan unit, and the tool is rotated to apply torque to the fan unit, such as for tightening onto a mounting structure.

13 Claims, 2 Drawing Sheets

METHOD OF APPLYING TORQUE TO A CPU FAN UNIT

BACKGROUND OF THE INVENTION

1. Field of the Invention

The invention relates to a torque tool for a CPU fan unit. More particularly, the invention relates to a tool for applying desired degrees of torque to a CPU fan unit, where the tool is adjustable so that it may be used with CPU fan units of various styles and sizes.

2. Description of Related Art

Many of the central processing units (CPUs) that are currently used with computers operate at high temperatures and thus generate a great amount of heat during use. In order to reduce the temperatures, CPU fan units are used to provide air flow to the CPU to dissipate the heat and reduce the likelihood of the CPU overheating. The fan unit is often mounted within the computer casing directly adjacent the CPU. The fan units are generally small in size to reduce the consumption of space. Moreover, the fan units are generally manufactured of a lightweight material to reduce the overall weight of the computer. As a result, the fan units are fragile and are easily broken if an assembler applies a relatively small threshold force to the fan unit.

The CPU fan unit is typically mounted within the computer casing by screwing an outer housing of the fan unit onto a mounting structure, such as a small clip or bracket. Like the CPU fan unit, the mounting structure is typically small and lightweight, making it easily susceptible to breaking. Currently, assemblers screw the fan unit onto the mounting structure by hand. The assembler typically grasps the outer housing of the fan unit and tightens it onto the mounting structure until the assembler feels resistance to further tightening. The amount of tightening the assembler applies to the fan unit is thus determined by "feel." As a result, the assembler often applies too much torque to the fan unit or applies uneven torque so that the fan unit twists during tightening. This may undesirably result in over-tightening and breakage of the fan unit or the mounting structure. There is, therefore a need for a tool specially designed to tighten CPU fan units onto a mounting structure in a computer. Such a tool should be adjustable for use with fan units of various sires And styles. The tool should also be adaptable for use with current torque driving tools, such as a ratchet wreath or torque screw driver. The tool should be capable of applying uniform and predetermined levels of torque to a fan unit in order to reduce the risk of over-tightening and breakage to the fan unit or mounting structure.

SUMMARY OF THE INVENTION

In one aspect of the invention, there is disclosed a method of tightening a first member having an outer housing onto a mounting structure. The method comprises providing a torque tool having two mounting pins movable along a common line, placing the first member onto the mounting structure, adjusting the position of the mounting pins so that the mounting pins are separated by a distance substantially equal to the diameter of the outer housing of the first member, removably engaging the mounting pins of the torque tool with the outer housing of the first member, and rotating the torque tool to apply torque to the first member so that the first member rotatably tightens onto the mounting structure.

Another aspect of the invention relates to a method of applying torque to a first member. The method comprises providing a tool having two mounting pins adjustably positioned along a common axis, adjusting the position of the mounting pins so that the mounting pins are positioned to engage the first member, engaging the mounting pins with the first member, and rotating the tool to apply torque to the first member.

In yet another aspect of the invention, there is disclosed a method of coupling a first member to a mounting structure. The method comprises providing a first member having a mounting portion, providing a mounting structure shaped to receive the mounting portion, providing a tool having two engagement structures adjustably separated by a distance, adjusting the distance between the engagement structures so that the engagement structures are positioned to engage the first member, and engaging the engagement structures with the first member. The method further comprises mating the mounting portion of the first member with the mounting structure, and rotating the tool to apply torque to the first member through the engagement structures.

BRIEF DESCRIPTION OF THE DRAWINGS

These and other features of the invention will now be described with reference to the drawings of one embodiment, which are intended to illustrate and not to limit the invention, and in which.

DETAILED DESCRIPTION OF THE INVENTION

Figure 1:
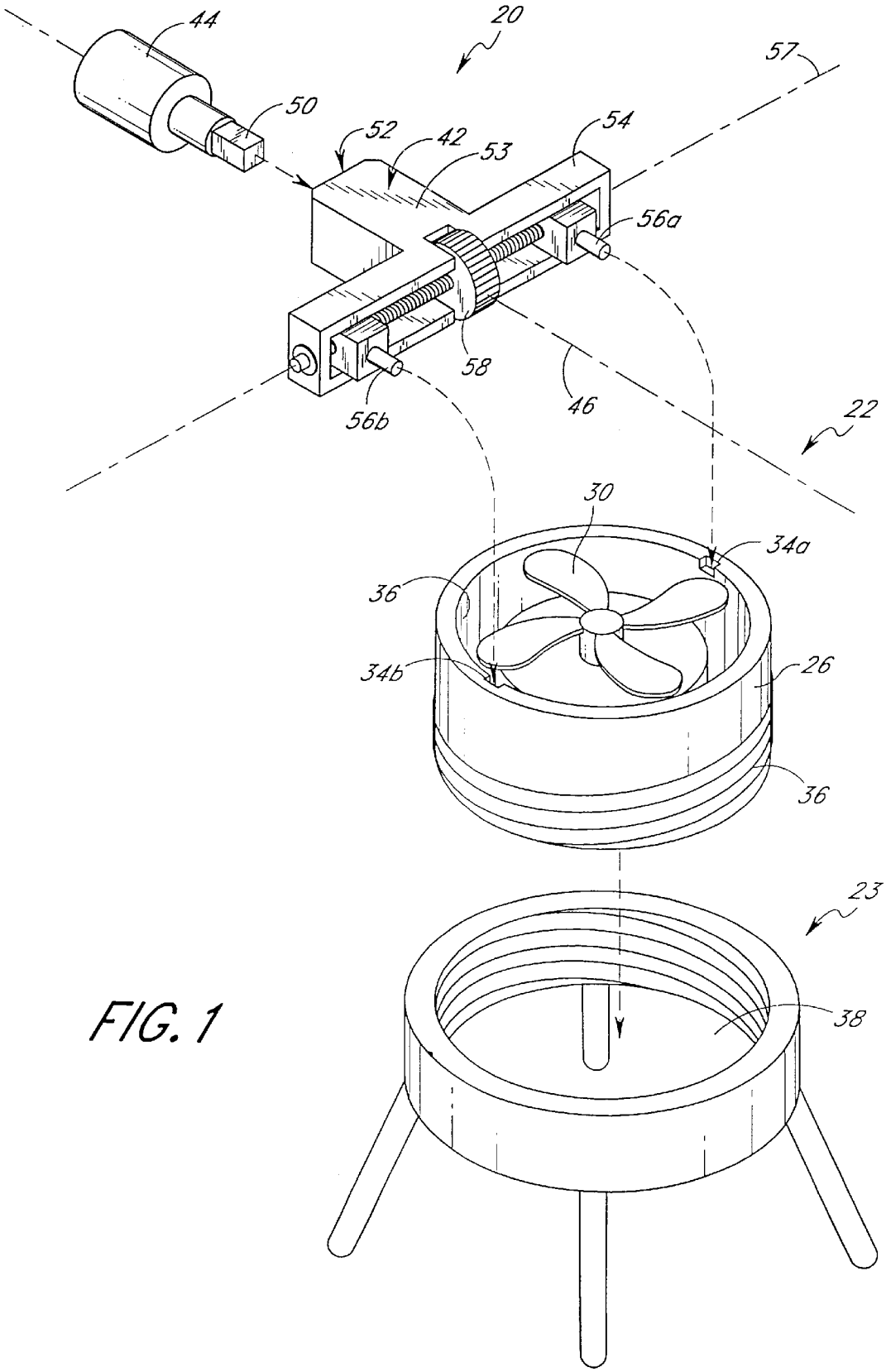
FIG. 1 is a perspective view of an embodiment of a CPU fan torque tool shown in combination with a CPU fan unit and mounting structure.

Reference will now be made to the attached drawings wherein like numerals refer to like parts throughout. FIG. 1 is a perspective view of a CPU fan torque tool 20 positioned adjacent a CPU fan assembly 22. The torque tool 20 is used to apply torque to the CPU fan assembly 22 and thereby mount and tighten the fan assembly 22 onto a mounting structure 23. As described in detail below, the torque tool is adjustable so that it may be used with CPU fan assemblies of various sizes and styles.

Referring to FIG. 1, the illustrated embodiment of the CPU fan assembly 22 generally comprises a cylindrically-shaped fan housing 26 and a fan 30 rotatably mounted therein. A circular aperture 36 extends through a front face of the CPU fan housing 26 and communicates with the fan 30. In the illustrated embodiment, a pair of diametrically-opposed mounting notches 34*a* and 34*b* are located on the interior periphery of the fan housing 26 along the perimeter of the aperture 32. Alternatively, the mounting notches 34 may be located on the outer surface of the fan housing 26. It will be appreciated that the shape of the fan housing 26 is not limited to a cylindrical shape, but could take on any of a wide variety of shapes. Additionally, the fan 30 may comprise any of a wide variety of fan types used to cool CPUs.

Referring to FIG. 1, the exterior rear of the fan housing 26 includes a threaded portion 36. The threaded portion 36 rotatably mates with a correspondingly-threaded aperture 38 in the mounting structure 23. In the illustrated embodiment, the mounting structure 23 comprises a frame-like member configured to receive the fan housing 26 through the aperture 38. It will be appreciated that the mounting structure could comprise any of a wide variety of well-known mounting structures for CPU fan units. Additionally, although in the illustrated embodiment the fan assembly 22 is a male member and the mounting structure 38 is a female member, it will be appreciated that the mounting structure 38 and fan housing 26 could mate in any combination of threaded male-female relationships.

During use, the fan 30 rotates and draws air into the fan housing 26 through the aperture 32 in a well known manner. The air flow is then exhausted through the rear of the fan housing 26 and onto the CPU for cooling. The fan assembly 22 is installed within the computer directly over the processing chip (not shown) by screwing the fan assembly 22 onto the mounting structure 38. However, those skilled in the art will appreciate that the fan assembly 22 may be mounted in any of a wide variety of locations within the computer.

Referring to FIG. 1, the torque tool 20 generally comprises an adapter portion 42 and a torque driver 44 configured to removably couple with the adapter portion 42. The adapter portion 42 and torque driver 44 together generally extend along an axis 46. When coupled, the adapter portion 42 and torque driver 44 are rotated to apply torque to the fan assembly 22 about the axis 46, as described more fully below. The torque driver 44 may comprise any of a wide variety of tools for applying torque, such as a ratchet wrench or a screw-driver type tool with a socket at its end for coupling to the adapter portion. In one embodiment, the torque driver 44 comprises a tool of the type that an installer may configure to apply only a desired threshold level of torque, as will be known to those skilled in the art. In this manner, an installer may set the set the torque driver 44 so that the torque tool 20 will not over-tighten the fan assembly onto the mounting structure 38.

As shown in FIG. 1, the adapter portion 42 and torque driver 44 mate using a standard socket-type coupling. Specifically, a male member 50 extends from one end of the torque driver 44. The male member 50 mates in a press-fit fashion to a correspondingly-shaped female member 52 located at a coupling end of the adapter portion 42. The male and female couplers 50, 52 together comprise a socket connection of the type that is commonly used to couple a ratchet wrench handle or a screwdriver handle to a socket of a socket wrench. In this manner, the adapter portion 42 may be used in combination with any of a wide variety of torque driving tools that are commonly available in assembly shops. Alternatively, the adapter portion 42 and torque driver 44 may be integrally formed into a single unit. It will be appreciated that the adapter portion 42 of the invention can be modified to be used with any of a wide variety of well-known torque tools without departing from the spirit of the present invention.

As shown in FIG. 1, the adapter portion 42 generally includes a main section 53 and elongated head section 54 that includes two pins 56*a* and 56*b* for engaging with the fan assembly 22, as described more fully below. The elongated head section 54 generally extends along an axis 57 that is oriented substantially normal to the axis 46. The pins 56*a*, 56*b* extend from the head section 54 in a direction substantially parallel to the axis 46. The pins 56*a*, 56*b* are each positioned along the axis 57 an equal distance D (FIG. 3) from the point where the axis 44 intersects the axis 57. The distance D is adjustable through use of an actuation member 58 located on a central portion of the head section 54, as described more fully below. In the illustrated embodiment, the actuation member 54 is a knob that rotates about the axis 57. It is contemplated that the actuation member 54 could also comprise any of a wide variety of easily-actuated mechanical structures, such as a lever.

Figure 3:
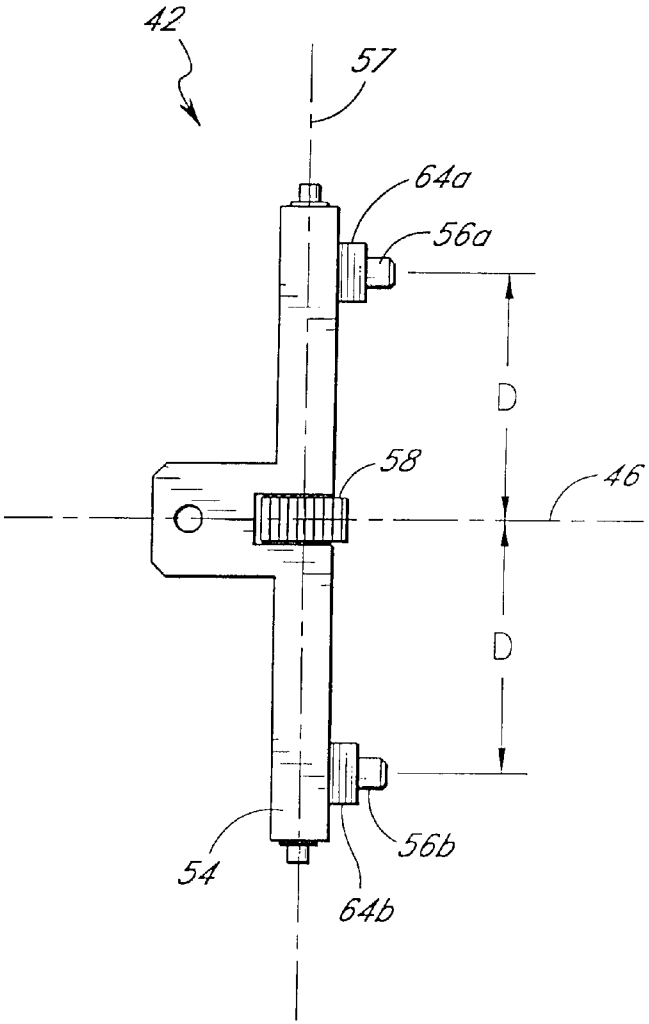
FIG. 3 is a side view of the torque tool of FIG. 2 taken along the line 3—3.
Figure 2:
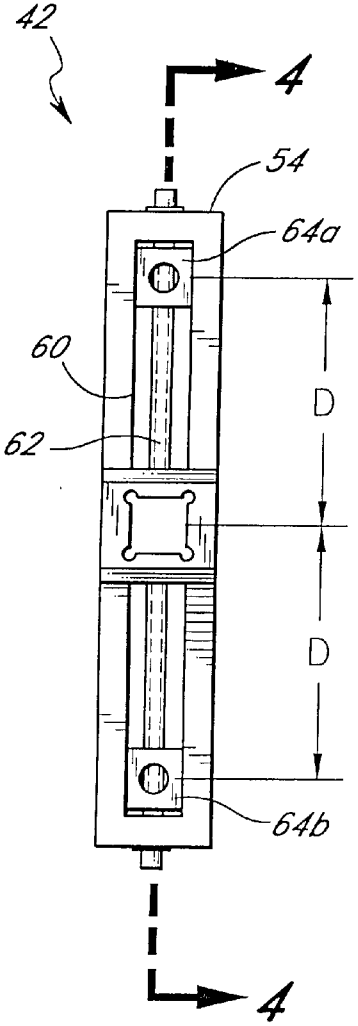
FIG. 2 is a front view of the torque tool of FIG. 1.

FIGS. 2 and 3 illustrate front and side views, respectively, of the adapter portion 42 of the torque tool 20. As best shown in FIG. 2, an elongated aperture 60 extends into the front of the head section 54. A threaded rod 62 extends within the head section 54 along the axis 57 so as to be visible through the elongated aperture 60. A central section of the threaded rod 62 is fixedly engaged with the actuation member 58 so that rotation of the actuation member 58 causes rotation of the threaded rod 62. The actuation member 58 divides the threaded rod 62 into a right-hand threaded section and a left-hand threaded section. That is, the portion of the threaded rod 62 to one side of the actuation member 58 has right-handed threads and the portion to the other side of the actuation member 58 has left-hand threads, the function of which will become apparent from the disclosure herein.

As shown in FIGS. 2 and 3, mounting blocks 64*a* and 64*b* are mounted on the threaded rod 62 on either side of the actuation member 58, as described in detail below. As best shown in FIG. 3, the mounting blocks 64*a* and 64*b* are sized such that a portion of each of the mounting blocks 64*a* and 64*b* extends outward through the elongated aperture 60. The pins 56*a*, 56*b* extend from these portions of the mounting blocks 64*a*, 64*b*. Referring to FIG. 2, the width of the mounting blocks 64*a*, 64*b* are slightly smaller than the width of the elongated aperture 60 so that the mounting blocks 64*a*, 64*b* are slidable along the length of the elongated aperture 60.

Figure 4:
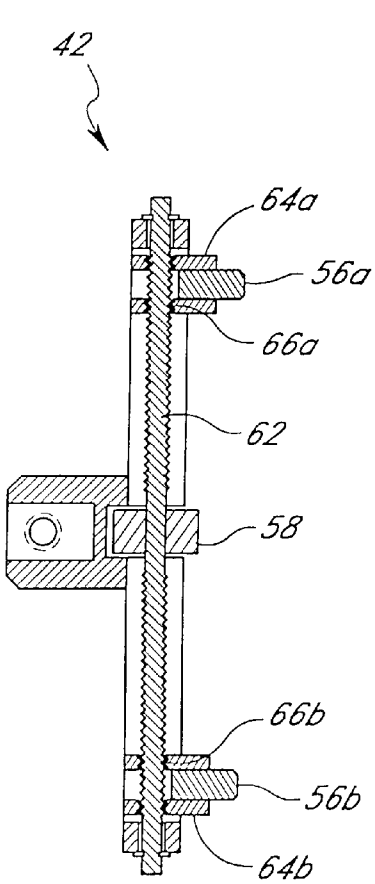
FIG. 4 is a cross-sectional view of the torque tool of FIG. 2 taken along the line 4—4.

FIG. 4 is a cross-sectional view of the adapter portion 42 taken along line 4—4 of FIG. 2. As shown, the threaded rod 62 extends through internal threaded apertures 66*a*, 66*b* in each of the mounting blocks 64*a* and 64*b*, respectively. The threads of the threaded apertures 66*a* and 66*b* are in meshed engagement with the threads of the threaded rod 62. When the threaded rod 62 is rotated via the actuation member 58, the threaded engagement between the threaded rod 62 and the internal threaded apertures 66*a* and 66*b* causes the mounting blocks 64*a*, 64*b* to move along the length of the threaded rod 62. Because the mounting blocks 64*a*, 64*b* extend through the elongated aperture 60, the mounting blocks 64*a*, 64*b* do not rotate with the threaded rod 62 but are rather guided along the length of the elongated aperture 60.

As discussed, the threaded rod 62 is divided into a right-hand threaded section and a left-hand threaded section on either side of the actuation member 58. Thus, as the threaded rod 62 rotates (through rotation of the actuation member 58), the mounting blocks 64*a* and 64*b* travel in opposite directions along the length of the threaded rod 62. For example, the actuation member 58 may be rotated in one rotational direction to move the mounting blocks 64*a* and 64*b* toward each other and thereby reduce the distance D. When the actuation member 58 is rotated in the opposite direction, the mounting blocks 64*a* and 64*b* move away from each other to increase the distance D. The particular relationship between the direction of rotational movement of the actuation member 58 and the direction of linear movement of the blocks 64*a*, 64*b* is determined by which side of the actuation member the left hand and right hand threaded sections are located. This may be varied without departing from the scope of the invention.

Referring to FIG. 4, in one embodiment, the pins 56*a*, 56*b* are removably coupled to the mounting blocks 64*a*, 64*b*. In particular, each pin 56 has a dowel section that mates in a press-fit fashion with a recess of corresponding size and shape that extends into each of the mounting blocks 64*a*, 64*b*. Because the pins 56*a*, 56*b* are removably coupled to the mounting blocks 64*a*, 64*b*, a user may install pins of various sizes or shapes that are particularly suited to engage particular fan assemblies.

FIG. 1 illustrates one manner in which the torque tool 20 is used to apply torque to a fan assembly 22 and thereby tighten the fan assembly 20 onto the mounting structure 23. First, the threaded section 36 is at least partially engaged with the threaded aperture 38 in the mounting structure 23. The pins 56*a* and 56*b* are then engaged with the mounting notches 34*a* and 34*b*, respectively, on the fan housing 26. The size of the pins 56*a*, 56*b* is selected so that the pins 56*a*, 56*b* fit snugly into the mounting notches 34. Because the pins 56*a*, 56*b* are removably coupled to the mounting blocks 64*a*, 64*b*, pins having a size and shape suited for the particular mounting notches 34 may advantageously be selected and coupled to the torque tool 20. When the pins 56*a*, 56*b* are engaged with the mounting notches 34, a user applies torque to the fan assembly 22 by rotating the torque driver 44. The engagement between the pins 56*a*, 56*b* and the mounting notches 34 transfers the torque from the torque driver 44 to the fan assembly 22. This causes the fan assembly 22 to rotate so that the threaded portion 36 tightens onto the mounting structure 23.

The torque tool 20 may advantageously be used to apply torque to CPU fan assemblies of various sizes by adjusting the distance between the pins 56*a*, 56*b* using the actuation member 58. The user rotates the actuation member 58 to move the pins 56*a*, 56*b* along the axis 57 until the distance between the pins 56*a*, 56*b* corresponds to the distance between the mounting notches 34. Toward this end, in one embodiment the actuation member 58 is positioned where the user's thumb is located when the user holds the torque tool 20. In this manner, the user may position the torque tool 20 adjacent the fan assembly 20 and rotate the actuation member 58 with the thumb until the pins 56*a*, 56*b* engage the mounting notches 34. It will be appreciated that the size of the threads on the threaded rod 62 may be varied to provide various distances of travel of the pins 56*a*, 56*b* as the actuation member 58 is rotated.

The pins 56*a*, 56*b* can also be engaged with various other locations on the fan assembly 22 if the particular fan assembly 22 does not have mounting notches provided thereon. For instance, the position of the pins 56*a*, 56*b* can be adjusted to butt against the outside surface of the fan housing 26. For such coupling, the user engages the torque tool 20 to the fan assembly 22 by moving the pins 56*a*, 56*b* closer to each other until the pins 56*a* and 56*b* squeeze and hold the housing 26 therebetween. Alternatively, the position of the pins 56*a*, 56*b* can be adjusted so that the pins press against the inner surface of the fan housing 26. The position of the pins 56*a*, 56*b* can also be adjusted to engage a portion of the fan 30. Once the pins 56*a*, 56*b* are engaged with the fan assembly 22, the user may apply torque in the manner described above.

In the illustrated embodiment, the pins 56*a*, 56*b* have a cylindrical shape. Such a shape is desirable because it will fit into mounting notches 34 of various shapes. In one embodiment, the pins have a diameter of approximately ⅛ inch. It will be appreciated that the shape and texture of the pins 56*a*, 56*b* can also be configured to increase the likelihood of the pins 56*a*, 56*b* securely engaging the outer or inner surface of the fan assembly 22 if no mounting notches 34 are present. For instance, the pins 56 can have jagged or curved outer surfaces to facilitate a secure engagement between the pins 56*a*, 56*b* and the surface of the housing 26. As discussed above, the pins 56*a*, 56*b* are removable so that a user may install pins 56*a*, 56*b* particularly suited for the job at hand.

The torque tool 20 is thus a tool specially designed to tighten CPU fan units onto a mounting structure in a computer. The torque tool 20 is advantageously adjustable so that it may be used with fan units of various sizes and styles. The tool 20 is configured to be removably mounted to current torque driving tools, such as a socket screw driver or ratchet wrench. The torque tool 20 is capable of applying uniform and predetermined levels of torque to a fan unit in order to reduce the risk of over-tightening and breakage to the fan unit or mounting structure.

Although the foregoing description of the invention has shown, described and pointed out the fundamental novel features of the invention, it will be understood that various omissions, substitutions, and changes, in the form of the detail of the apparatus as illustrated, as well as the uses thereof, may be made by those skilled in the art without departing from the spirit of the present invention. Consequently, the scope of the invention should not be limited to the foregoing discussion, but should be defined by the appended claims.

What is claimed is:

1. A method of tightening a fan assembly having an outer housing onto a mounting structure, comprising:

providing a torque tool having two mounting pins movable along a common line;

placing the fan assembly onto the mounting structure;

adjusting the position of the mounting pins so that the mounting pins are separated by a distance substantially equal to the diameter of the outer housing of the fan assembly;

removably engaging the mounting pins of the torque tool with the outer housing of the fan assembly by inserting the mounting pins in mounting notches located on the outer housing of the fan assembly; and rotating said torque tool to apply torque to said fan assembly so that said fan assembly rotatably tightens onto said mounting structure.

2. The method of claim 1, wherein the mounting pins are removably mounted to the torque tool and wherein the method further comprises attaching mounting pins to the torque tool.

3. The method of claim 2, additionally comprising selecting mounting pins that are sized to fit into mounting notches in the outer housing of the fan assembly.

4. The method of claim 1, wherein the torque tool includes a detachable torque driver and wherein the method further comprises attaching said torque driver to said torque tool.

5. The method of claim 4, additionally comprising setting the torque driver to apply a pre-determined amount of torque.

6. A method of applying torque to a CPU fan assembly having two notches formed in an outer housing of the CPU fan assembly, comprising:

providing a tool having two mounting pins adjustably positioned along a common axis;

adjusting the position of the mounting pins so that the mounting pins can be positioned in the two notches formed in the outer housing of the CPU fan assembly to engage the CPU fan assembly;

engaging the mounting pins with the notches in the CPU fan assembly;

rotating the tool to apply torque to the CPU fan assembly.

7. The method of claim 6, wherein engaging the mounting pins with the CPU fan assembly comprises squeezing the outer housing between the mounting pins.

8. The method of claim 6, wherein the mounting pins are removably attached to the tool, and wherein the method additionally comprises selecting mounting pins having a size and shape corresponding to the size and shape of the mounting notches and attaching the mounting pins to the tool.

9. A method of coupling a fan having an outer housing and a mounting portion to a mounting structure shaped to receive the mounting portion, comprising:

adjusting the distance between two engagement structures of a tool so that said engagement structures are positioned to engage said fan by being positioned within notches formed in the mounting portion of the fan;

engaging the engagement structures with the fan by positioning the engagement structures in the notches of the mounting portion of the fan;

mating the mounting portion of the fan with the mounting structure;

rotating the tool to apply torque to the fan through the engagement structures.

10. The method of claim 9, wherein adjusting the distance between the engagement structures comprises setting the distance equal to the diameter of the outer housing.

11. The method of claim 10, wherein the engagement structures are pins, and wherein engaging the engagement structures with the fan comprises engaging the pins with the fan housing.

12. The method of claim 10, wherein the fan housing includes mounting notches and wherein engaging the engagement structures with the fan comprises inserting the pins into the mounting notches.

13. The method of claim 11, wherein engaging the pins with the fan comprises squeezing the fan housing between the pins.

* * * * *

UNITED STATES PATENT AND TRADEMARK OFFICE

CERTIFICATE OF CORRECTION

PATENT NO. : 6,112,397
DATED : September 5, 2000
INVENTOR(S) : Boe

It is certified that error appears in the above-identified patent and that said Letters Patent is hereby corrected as shown below:

Column 1,
Line 44, please delete "sires And styles." and replace therefor -- sizes and styles --.

Column 3,
Line 34, please delete -- the set --.

Signed and Sealed this

Sixth Day of November, 2001

*Attest:*

Nicholas P. Godici

*Attesting Officer*

NICHOLAS P. GODICI
*Acting Director of the United States Patent and Trademark Office*